United States Patent [19]

Pages

[11] Patent Number: 4,508,004

[45] Date of Patent: Apr. 2, 1985

[54] SEALING PAD FOR MUSICAL INSTRUMENT

[75] Inventor: Gérard Pages, Saint Germain en Laye, France

[73] Assignee: Le Joint Francais, Paris, France

[21] Appl. No.: 574,430

[22] Filed: Jan. 27, 1984

[30] Foreign Application Priority Data

Jan. 27, 1983 [FR] France ..... 83 01213

[51] Int. Cl.[3] ..... G10D 9/04

[52] U.S. Cl. ..... 84/385 P

[58] Field of Search ..... 84/385 P

[56] References Cited

U.S. PATENT DOCUMENTS

| | | | |
|---|---|---|---|
| 3,205,752 | 9/1965 | Carruthers | 84/385 P |
| 3,501,991 | 3/1970 | Carruthers et al. | 84/385 P |
| 3,958,484 | 5/1976 | Nelson et al. | 84/385 P |

FOREIGN PATENT DOCUMENTS

| | | | |
|---|---|---|---|
| 1903244 | 9/1969 | Fed. Rep. of Germany . | |
| 1255957 | 2/1961 | France | 84/385 P |
| 246255 | 4/1926 | Italy | 84/385 P |

*Primary Examiner*—Lawrence R. Franklin

*Attorney, Agent, or Firm*—Sughrue, Mion, Zinn, Macpeak, and Seas

[57] ABSTRACT

Woodwind or like musical instruments comprise a hollow body (2) pierced by tone holes (3) which are closable by means of respective finger-actuated keys (1). The keys may themselves optionally be pierced by further respective holes or orifices (11). A sealing pad (20) for such a key comprises a fixed annular portion (21) for fixing to the key, and a movable annular lip (23) suitable for being pinched between the fixed annular portion of the pad and the rim (4) of a tone hole when the tone hole is closed by the pad.

8 Claims, 4 Drawing Figures

SEALING PAD FOR MUSICAL INSTRUMENT

The present invention relates to a sealing pad for the key of a woodwind or like musical instrument, said instrument comprising a hollow body pierced by tone holes which are closable by means of respective finger-actuated keys, said keys being themselves optionally pierced by further respective holes.

BACKGROUND OF THE INVENTION

In so-called "woodwind" musical instruments, such as flutes, clarinettes, saxophones, oboes, and bassoons, and which need not be made of wood, a column of air is set in vibration inside a hollow tubular body which is generally of circular section. A player varies the pitch of the note emitted by the instrument by varying the length of the column of air vibrating inside the instrument. This is done by opening and closing tone orifices which are distributed along the length of the instrument.

Closing the orifices obviously presents a sealing problem.

Sealing pads are thus included in the keys. The pads must avoid creating interfering noises when the orifices are closed. They must also be both flexible and firm so that the player can feel that an orifice is properly closed without having to press down too hard on the key.

In the prior art, the pads used are generally flat and made of felt covered in a skin, and although they perform all these functions, they nevertheless present drawbacks.

They are sensitive to damp and to ageing which deteriorate their airtightness.

These drawbacks have been avoided by using flexible sealing pads made of elastomer. One known pad comprises a flexible sealing disk mounted between two rigid metal washers themselves supported on a flexible column which enables the pad assembly to tilt slightly in order to close an orifice in an instrument. However, this type of pad requires specially constructed keys and cannot replace a worn felt and skin pad on an existing key. Further, the presence of the flexible column in the middle of the key means that this type of pad cannot be used for pierced keys.

Preferred embodiments of the present invention thus provide a flexible sealing pad which ensures good airtightness, which is firm so that closure is easy to feel, and which is insensitive to damp and to ageing.

Further, the pad can be fitted to existing keys which have previously been fitted with a felt and skin pad, and is thus interchangeable with a felt and skin pad.

SUMMARY OF THE INVENTION

The present invention provides a sealing pad for the key of a woodwind or like musical instrument comprising a hollow body pierced by tone holes which are closable by means of respective finger-actuated keys, said keys being themselves optionally pierced by further respective holes, wherein the pad comprises a fixed annular portion for fixing to a key and a movable annular lip suitable for being pinched between said fixed annular portion of the pad and the rim of a tone hole when said tone hole is closed by said pad.

The fixed annular portion and the movable annular lip may be made in a single piece. However it is advantageous for the fixed annular portion to be made in two pieces, with the movable annular lip either being part of one of said two pieces or else being constituted by a third piece.

Advantageously, both the fixed annular portion and the movable annular lip are made of flexible polymer.

BRIEF DESCRIPTION OF THE DRAWINGS

Embodiments of the invention mounted on the key of a flute are described by way of example with reference to the accompanying drawings in which.

MORE DETAILED DESCRIPTION

Figure 1:
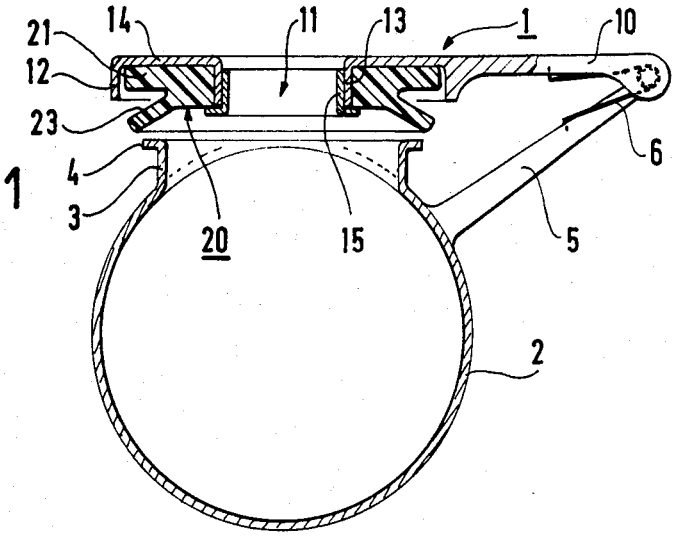
FIG. 1 is a cross section through the body of a flute and a pierced key in an open position over the body, said key being fitted with a one piece sealing pad.

FIG. 1 shows the body 2 of a flute of circular cross section. There is a tone orifice 3 likewise of circular cross section through the wall of the flute body 2, and the tone orifice is terminated by a rim 4. A generally disk-shaped key 1 has a radially extending tab 10 which is hinged to the far end of an arm 5 projecting from the flute body 2. The key 1 is shown in the open position to which it is resiliently urged by a spring 6 located around the hinge between the arm 5 and the tab 10. The key is closed by a player's finger pressing down on it. When the key is released by the player's finger, the spring 6 returns the key to the open position.

The key 1 comprises a centrally pierced disk 14 having a peripheral cylindrical wall 12 around its outer edge and an inner cylindrical wall 13 around a central orifice 11. An annular sealing pad 20 is received under the disk 14 between the walls 12 and 13. The pad is made from a single piece of rubber and comprises a fixed annular portion 21 and a movable lip 23. The sealing pad is retained in the key by a ring 15 which is a tight fit in the inner wall 13.

When the player presses the key 1 down, the tone hole 3 is closed by the lip 23 which begins closure by being deformed against the rim 4. As the key moves closer to the rim 4, the lip 23 is pinched between the rim 4 and the fixed annular portion 21 of the pad. When this situation is reached, the key provides airtight closure of the tone hole 3, while the player's finger provides airtight closure of the central orifice 11.

The pad must be both flexible to ensure airtight sealing, and firm to give the player the feeling that the tone hole has been properly closed in spite of the various different pressures which are in play during closure.

Figure 2:
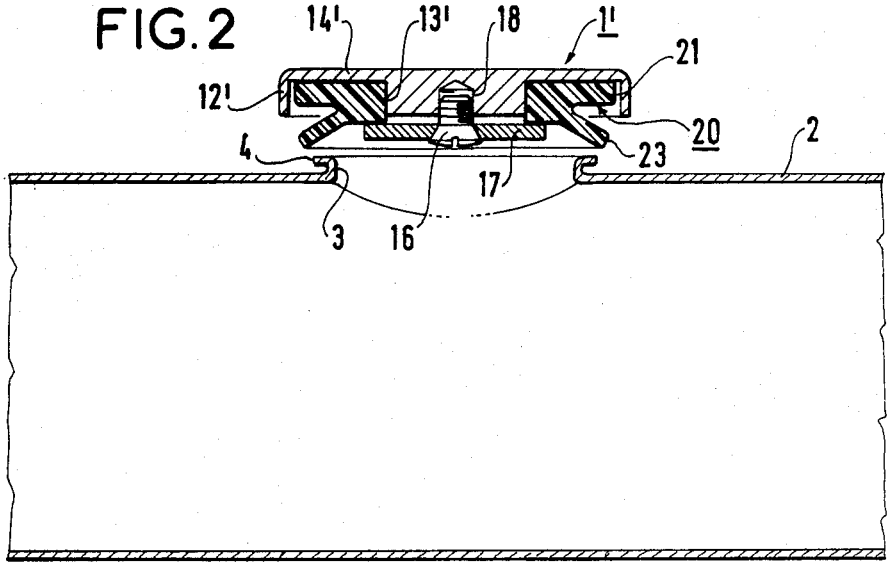
FIG. 2 is a longitudinal section through the body of a flute and a non-pierced key in an open position over the body, said key being fitted with a one piece sealing pad as shown in FIG. 1.

FIG. 2 is a section through a different key and is on a plane at right angles to the plane of FIG. 1. FIG. 2 shows an identical pad 20, likewise made of rubber, but mounted in a key 1' which does not have a central orifice 11. The key 1' has a peripheral wall 12' which is connected via a tab (not shown) to an arm (not shown) projecting from the flute body in the same manner as illustrated in FIG. 1. The pad is centered on a central hub having a cylindrical wall 13', and bears against a disk 14'. A washer 17 holds the pad in place and is itself fixed to the central hub by means of a screw 16 received in a tapped hole 18.

As in the FIG. 1 embodiment, a player applying a finger to the key causes the lip 23 to bear against the rim 4 of the corresponding tone hole 3, and then pinches the lip 23 between the rim 4 and the fixed annular portion 21.

Figure 3:
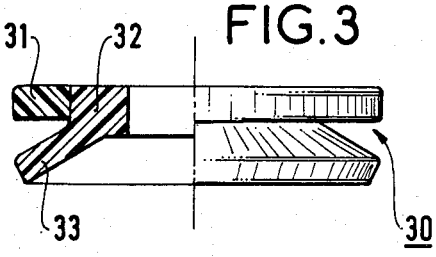
FIG. 3 is a half section through a two piece pad.
Figure 4:
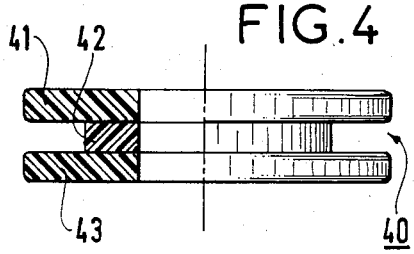
FIG. 4 is a half section through a three piece pad.

FIGS. 3 and 4 are partial axial sections through sealing pads which are more easily molded than are the pads shown in FIGS. 1 and 2.

FIG. 3 shows a pad 30 comprising two distinct pieces 31 and 32.

The piece 31 is a simple ring, while the piece 32 which is received inside the ring 31 comprises both a ring and a movable lip 33. The lip 33 is functionally the same as the lip 23, but the two part pad structure avoids molding a re-entrant shape. The outer ring piece 31 need not be made of the same material as the inner ring piece which includes the lip 33. While the lip 33 is best made of flexible material such as rubber, the outer ring piece 31 could be made of a relatively hard plastic.

FIG. 4 shows a pad 40 comprising three distinct pieces 41, 42, and 43. In this structure, the first piece 41 is a fixed ring which is received in the key, the second piece 42 is an intermediate fixed ring of smaller outside diameter, and the third piece 43 is a flexible ring serving as the lip which deforms against the rim 4 of the tone hole under finger pressure from the player. The first and second pieces 41 and 42 may be made of a relatively hard plastic, while the third piece 43 is made of a flexible material such as rubber or the like.

The sealing pad made be fixed in a key by means other than those shown, particularly if the key is small or made of plastic. For example, the pad may be glued in place, or it may be molded in situ, thus providing a composite insert.

I claim:

1. A sealing pad for a key of a woodwind or like musical instrument, said instrument comprising a hollow body pierced by circular tone holes, respective finger-actuated keys pivotably mounted to said body, said keys including a disc overlying a respective tone hole for movement towards said body for closing of said tone hole, said keys being optionally pierced by further respective holes, said pad comprising a first annular portion for fixedly mounting to said key beneath said disc and an annular lip underlying said first annular portion of said pad being free of said first annular portion and being flexible and movable relative to said first annular portion, and wherein said disc, said first annular portion and said annular lip being of a diameter in excess of the diameter of said tone hole such that said movable annular lip is capable of being pinched between said first annular portion of said pad and the rim of said tone hole when said key is pivoted towards said body, and said tone hole is closed by said pad.

2. A pad according to claim 1, wherein the first annular portion and the movable annular lip are made in a single piece.

3. A pad according to claim 1, wherein the first annular portion is made in two pieces, one of which is integral with the movable annular lip.

4. A pad according to claim 3, wherein the movable annular lip is made of flexible polymer material.

5. A pad according to claim 1, wherein the first annular portion is made of flexible polymer material.

6. A pad according to claim 1, wherein the first annular portion is made in two pieces including an upper portion of a diameter in excess of the diameter of the tone hole, and a second piece underlying said first piece and of a diameter less than that of said tone hole, and wherein said movable annular lip is constituted by a third piece underlying said second piece.

7. A pad according to claim 6, wherein the movable annular lip is made of flexible polymer material.

8. A pad according to claim 6, wherein the first annular portion is made of flexible polymer material.

* * * * *